US007093322B2

(12) United States Patent
Townend

(10) Patent No.: US 7,093,322 B2
(45) Date of Patent: Aug. 22, 2006

(54) COUNTER-BALANCE WEIGHT FOR A MODULAR SAFETY RAIL

(75) Inventor: David Townend, Shropshire (GB)

(73) Assignee: Access Technologies Limited, West Midlands (GB)

( * ) Notice: Subject to any disclaimer, the term of this patent is extended or adjusted under 35 U.S.C. 154(b) by 50 days.

(21) Appl. No.: 10/860,270

(22) Filed: Jun. 4, 2004

(65) Prior Publication Data

US 2005/0000060 A1 Jan. 6, 2005

(30) Foreign Application Priority Data

Jun. 5, 2003 (GB) ..... 0312962.4

(51) Int. Cl.
*E05F 1/00* (2006.01)

(52) U.S. Cl. ..... 16/400

(58) Field of Classification Search ..... 16/400, 16/402; 256/1, 65.14; 52/127.2, 127.3, 52/127.1, 741.1
See application file for complete search history.

(56) References Cited

U.S. PATENT DOCUMENTS

| | | | | |
|---|---|---|---|---|
| 1,946,970 | A * | 2/1934 | Grandgent | 49/200 |
| 2,123,679 | A * | 7/1938 | Mahan | 74/591 |
| 3,245,181 | A * | 4/1966 | Stephenson | 52/126.4 |
| 3,342,457 | A * | 9/1967 | Bobrowski | 256/21 |
| 4,627,042 | A * | 12/1986 | Hara | 720/621 |
| 5,145,153 | A * | 9/1992 | Glynn | 256/59 |
| 5,188,342 | A | 2/1993 | Ouellette et al. | |
| 5,676,350 | A | 10/1997 | Galli et al. | |
| 6,257,559 | B1 * | 7/2001 | Mouri | 256/26 |
| 6,942,199 | B1 * | 9/2005 | Higgs et al. | 256/65.14 |

FOREIGN PATENT DOCUMENTS

| | | | |
|---|---|---|---|
| DE | 3803211 | | 8/1989 |
| DE | 286 198 | | 1/1991 |
| DE | 10253570 | A1 * | 5/2004 |
| EP | 1 293 686 | | 3/2003 |
| EP | 1 310 614 | | 5/2003 |
| GB | 2215171 | A * | 9/1989 |
| GB | 2289454 | A * | 11/1995 |
| GB | 2 383 788 | | 7/2003 |
| JP | 08134957 | A * | 5/1996 |
| JP | 2003312994 | A * | 11/2003 |

* cited by examiner

*Primary Examiner*—Chuck Y. Mah
(74) *Attorney, Agent, or Firm*—Young & Thompson

(57) ABSTRACT

A counter-balance weight for a modular safety rail comprises a substantially solid body which defines a passage to receive an end of an elongate spacer member, a recess region to house a retainer of a kind selectively securable to the elongate spacer member, an access opening for access to the retainer, and a retainer abutment to inhibit movement of the retainer in an axial direction which is parallel with the length direction of the elongate member.

33 Claims, 5 Drawing Sheets

SECTION AA

SECTION BB

SECTION CC

SECTION DD

COUNTER-BALANCE WEIGHT FOR A MODULAR SAFETY RAIL

BACKGROUND OF THE INVENTION

This invention relates to a counter-balance weight for a modular type safety rail and in particular, though not exclusively, to a counter-balance weight and to a modular safety rail assembly suitable for use in providing free-standing roof edge protection.

Modular type safety rail systems are well know and typically comprise straight lengths of metal tubing interconnected by connectors of different types such that, for example, two, three or four way interconnections of horizontally and vertically extending tubes may be achieved.

Tubes serving as vertical posts of a safety rail, and to which horizontally extending tubes are connected, are supported by metal base plates which, in use, rest on the surface of a roof. A flanged mounting socket typically is bolted to an upper surface of the plate, adjacent to one of the shorter edges of the rectangular shape, to provide location for the lower end of a vertical post.

The ability of the free-standing safety rail to avoid toppling when leant on may be achieved by a counter balance weight secured to the end of a spacer tube which, in use, extends horizontally over the roof surface and is secured rigidly to the base plate. This arrangement is particularly suitable if it is not possible or convenient to position a spacer bar to act as a stabiliser member which extends forwards, horizontally, in the direction of potential toppling.

If, however, space permits, a spacer tube may be arranged to extend forwards in the direction of potential toppling so as to act as a stabiliser bar. Optionally in that case the distal end of the stabiliser bar may be provided with a counter balance weight.

Commonly the counter-balance weight comprises a heavy metal plate and an end of a spacer tube is secured to the plate by being received firmly in a horizontally extending sleeve which is either bolted or welded to an upper surface of the plate.

An example of a typical known counter-balance weight is shown in perspective in FIG. 1. The counter-balance weight (10) comprises a rectangular shaped cast iron plate (11) which has welded (13) thereto a tubular sleeve (12) the bore (18) of which is dimensioned to receive the end of a spacer tube. The sleeve bore is provided with a pair of axially spaced screw threaded apertures (14) for receiving grub screws whereby the end of an horizontally extending spacer tube may be secured to the sleeve in known manner.

The aforedescribed construction as shown in FIG. 1 functions satisfactorily in use, but suffers the disadvantage of being costly to manufacture, by virtue for example of the need to weld the sleeve (12) to the plate (11), and, as well as presenting a trip hazard, is not as aesthetically pleasing as may be desirable for some installation locations. Additionally, if the sleeve (12) and plate (11) are pre-assembled by a manufacturer, the maximum possible ratio of weight to container space is not as high as would generally be preferred for reducing shipping costs of bulk supplies from a manufacturer to an importer or other distribution point. That may be a particular disadvantage if it is wished to construct the counter-balance weight from a material having a lower specific gravity than the typical specific gravity of a metal, such as cast iron, because the lighter material necessitates provision of a larger sized weight for the same counter-balance effect.

SUMMARY OF THE INVENTION

One object of the present invention is to provide means whereby at least some of the aforedescribed disadvantages of the conventional counter-balance weights may be mitigated or overcome.

In accordance with one aspect of the present invention a counter-balance weight for a modular safety rail comprises a substantially solid body, said body defining

- a passage to receive an end of an elongate spacer member;
- a recess region to house a retainer of a kind selectively securable to the elongate spacer member;
- an access opening for access to the retainer, and
- a retainer abutment to inhibit movement of the retainer in an axial direction which is parallel with the length direction of the elongate member.

The size of the access opening may be sufficiently large to enable a retainer to be inserted through that opening into the recess region or it may be of a smaller size which primarily only allows access to the retainer for the purpose of securing the retainer to an elongate spacer member or for release of the retainer.

The body may define a substantially planar major surface which, in use, is a lower surface intended to rest on a support surface. An upper surface may be substantially non-planar and may, for example, be curved as considered in cross-section or the body may, for example, be of a substantially triangular shape as considered in transverse section in a plane substantially perpendicular to a length direction of said passage.

Either an upper or lower surface of the body may be formed with a retainer opening which allows a retainer to be inserted into said recess region. If that retainer opening is in the lower surface it is preferred, though not essential, that said opening is not the only means of access to the retainer and that a said access opening is provided in the upper surface for selectively securing the retainer to a spacer member or for effecting release for disassembly of an installation.

In addition to said retainer abutment the body preferably defines a secondary abutment to inhibit relative axial movement between the spacer member and body in a direction opposite that in which the retainer abutment inhibits movement. The secondary abutment may be positioned for contact by a retainer or it may be an end region of said passage such that it is positioned for contact by the end of a spacer member. Although the invention envisages that typically the passage is closed at one end, particularly if the passage is in the form of a through-bore the secondary abutment will be of a kind for contact by a retainer.

In the case of a body having a secondary abutment for contact by a retainer, that abutment may be positioned and arranged such that it may be contacted by the same retainer as that which may contact said retainer abutment.

Alternatively, however, in a modular safety rail assembly of the present invention two retainers may be employed on an elongate spacer member. One or both may be positioned within the overall space envelope of the body or one may be provided in said recess and the other may lie outside the body to be contactable with an external surface of the body.

Preferably the counter-balance weight comprises substantially only said solid body. It may be shaped by casting or moulding.

One suitable material for forming the body member is a metal, e.g. a cast iron such as grey cast iron, though a malleable cast iron such as Blackheart cast iron may be employed. In the case of a body of cast iron, it may be provided with a protective coating for example by galvanising.

Although the counter-balance weight may be formed from a metallic material, the invention particularly envisages that it may alternatively be made from a non-metallic material such as rubber or polyvinylchloride (PVC). A recycled grade of material such as recycled rubber may advantageously be used to provide a durable and corrosion resistant product at relatively low cost.

One example of a suitable type of retainer is in the form of a metal ring the wall of which is provided with a screw threaded opening for supporting a screw member, such as a grub screw, which may be tightened to bear on the surface of an elongate spacer member extending through the ring. One particular example of a suitable type of a retainer is the FastClamp type C30 fitting available ex Access Technologies Limited.

The ratio of the width of the body as considered in a direction parallel with a base surface of the body, and perpendicular to the length of the passage, in relation to the height of the body, as considered in a direction perpendicular to said base surface, preferably is greater than 3:1, more preferably greater than or equal to 4:1.

Said height dimension preferably is less than three times the maximum diameter of a circular section spacer member which can be inserted in said passage, preferably less than or equal to twice said diameter.

The passage may be open to the base surface of the body over at least a part of the length of the passage. Preferably, however, at an end region the passage is not open to the base surface.

The body may comprise one or a plurality of access openings. In the case of two or more access openings, preferably they are axially spaced relative to the length of the passage. As considered in a transverse cross-sectional plane perpendicular to the length of the passage preferably the or each access opening is of a tapered shape increasing in width towards an upper surface of the body.

The passage may be of substantially circular section whereby, in use, the counter-balance weight readily may be tilted about the longitudinal axis of a spacer member so as to rest uniformly on a support surface, such as a roof or ground surface, despite any localised inclination of the support surface.

The passage may have a cross-sectional dimension which varies along the length thereof and said dimension may be greater at at least one end region than at a central region between said end regions. The body may have a major surface which in use is intended to rest on a support surface and the dimension of the passage in a direction perpendicular to said major surface may be greater at an or each end region of the passage than at a central region of the passage. The passage may be of varying dimension as considered in a first of two mutually perpendicular longitudinal planes which each contain the major axis of the passage and in the second of said longitudinal planes may have a dimension, at at least one of said end regions, which is no greater than at said central region.

An access opening may be provided spaced from a closed end region of a passage. One or a pair of wall surfaces of the opening or associated recess may serve to provide axial location of the retainer and spacer member relative to the body of the counter-balance weight. Alternatively an end face of the passage may co-operate with the end of a spacer member for relative axial location in one axial direction.

An access opening may be provided at a position aligned with an end region of the passage and may be dimensioned to allow a retainer to be inserted via the access opening into the end region of the passage, with a part of a wall surface of the access opening serving as a retainer abutment. Accordingly, in an assembled condition of a spacer member inserted into the passage at an end region which thereby serves as a recess region for housing the retainer, the retainer may be secured to an end region of a spacer member and interaction between the retainer and a wall surface of the access opening may result in the spacer member being retained axially relative to the counter-balance weight.

The present invention further provides a modular safety rail assembly comprising base connectors for supporting vertical posts of a safety rail and to which horizontally extending rail members are connected, and spacer members extending substantially horizontally from the base connectors, the distal end of each said spacer member having secured thereto a counter-balance weight in accordance with the present invention.

The assembly may comprise at least one of a counter-balance weight and a base connector of a type which permits a spacer member to be secured thereto in a range of positions inclined to a support face of the counter-balance weight or base connector whereby, in use, a spacer member may extend slightly inclined to a local surface region on which the weight or connector rests.

BRIEF DESCRIPTION OF THE DRAWINGS

One embodiment of the present invention will now be described, by way of example only, with reference to the accompanying diagrammatic drawings in which.

DETAILED DESCRIPTION OF THE PREFERRED EMBODIMENTS

A counter-balance weight (20) comprises a substantially solid body comprised substantially only of moulded recycled rubber.

Figure 1:
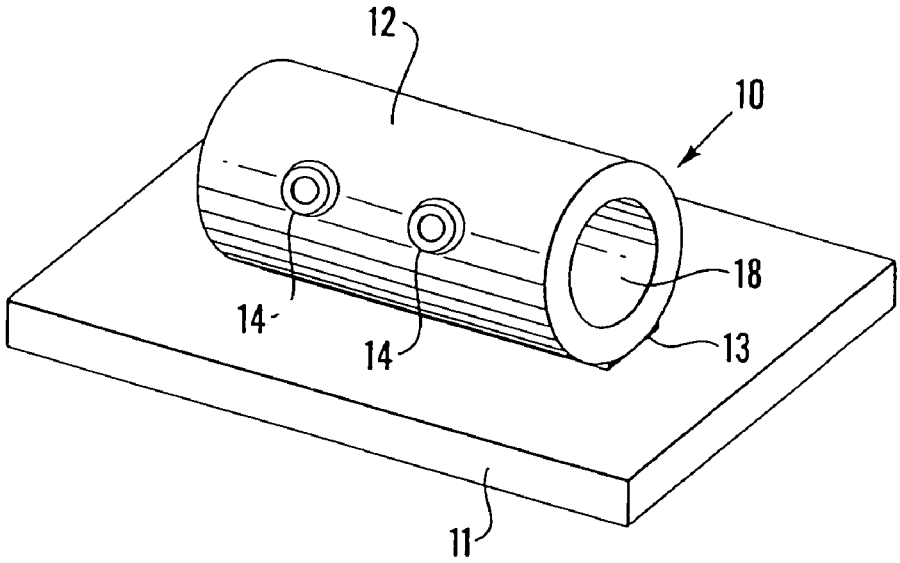
Fig. 1 (Prior Art)
FIG. 1 is a perspective view of a known counter-balance weight.
Figure 2:
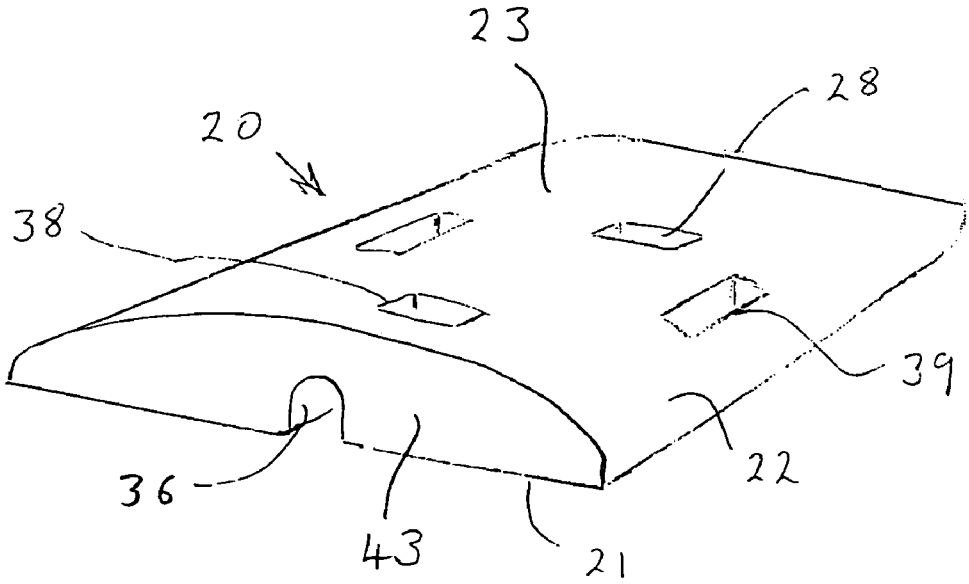
FIG. 2 shows in perspective a counter-balance weight in accordance with the present invention.
Figure 4:
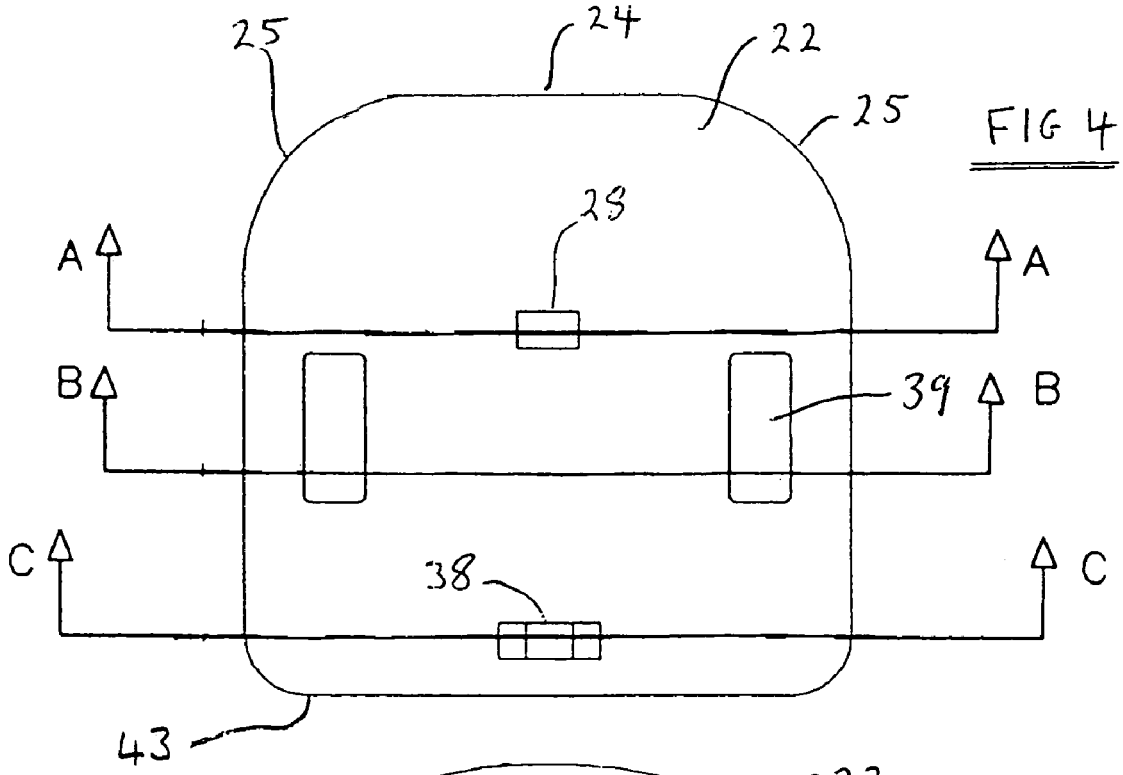
FIG. 4 is a plan view of the weight of FIG. 2.
Figure 3:
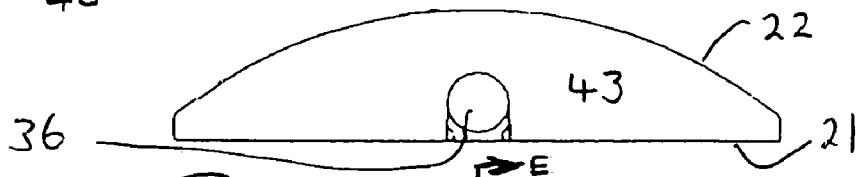
FIG. 3 shows a transverse end face of the weight of FIG. 2.
Figure 5:
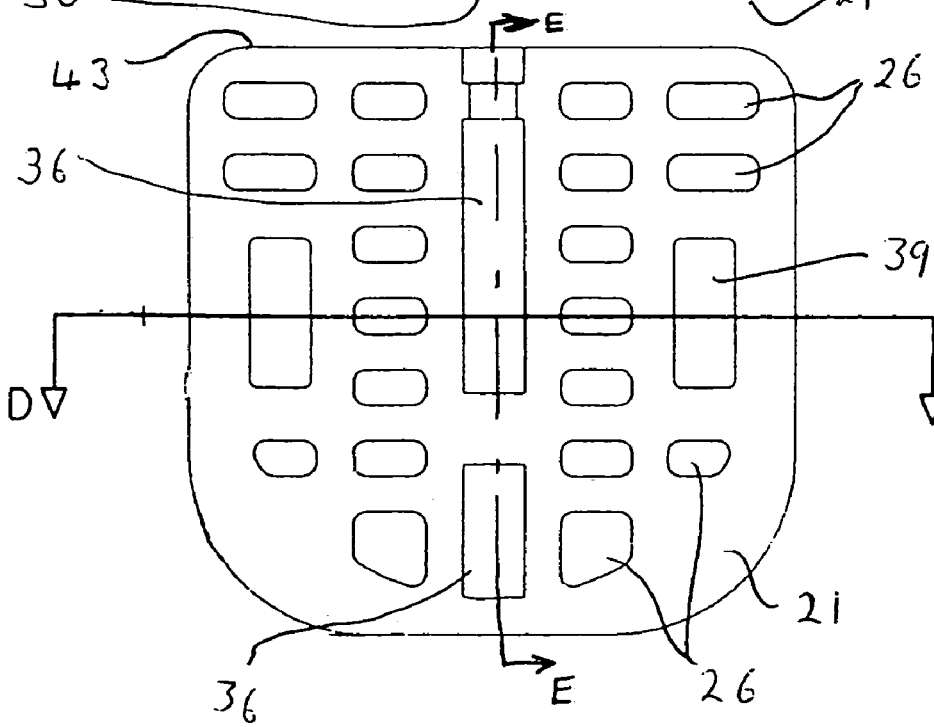
FIG. 5 is an underneath view of the weight of FIG. 2.
Figure 10:
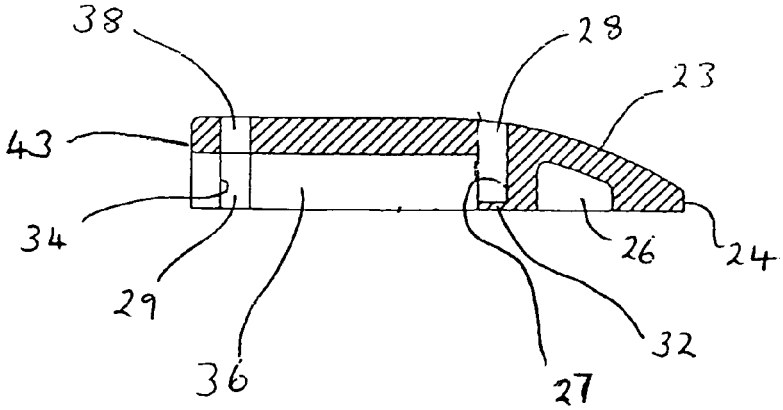
FIG. 10 is a longitudinal section on the line EE of FIG. 5.

The body is of generally rectangular shape as viewed in plan (see FIG. 4) and comprises a substantially planar base surface (21) and a curved (substantially part-cylindrical) upper surface (22) (see FIG. 3). Although the upper surface (22) is of generally part-cylindrical shape, at one end region (23) (see FIG. 10) it is curved to reduce in thickness to the end (24), opposite a planar end (43). Similarly corner regions (25) at the end (24) are also curved.

Figure 6:
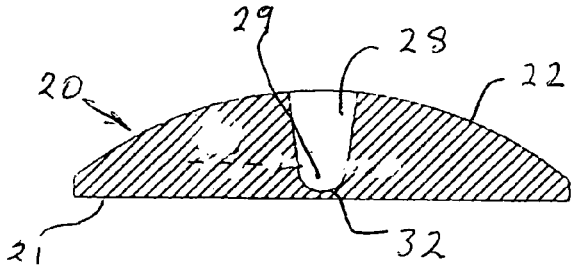
FIGS. 6, 7 & 8 are transverse sections on the lines AA, BB and CC of FIG. 4.
Figure 7:
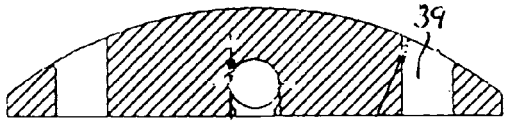
Figure 8:
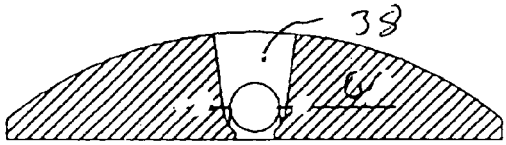
Figure 9:
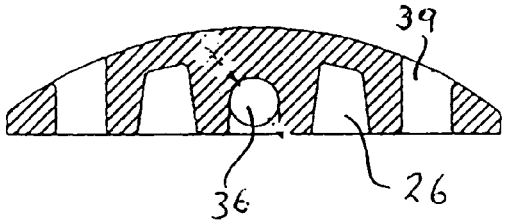
FIG. 9 is a transverse section on the line DD of FIG. 5.

For assistance with moulding and to provide the desired size to weight ratio the body comprises a plurality of cavities (26). Additionally it comprises a passage (36) for receiving an elongate spacer member, said passage extending lengthwise of the body in a direction perpendicular to the end region (24). A surface (27) of the body at the end of the passage (36) provides a secondary abutment against which the end of a spacer member may be positioned. Aligned with that end region of the passage the body is provided with a V section access opening (28) (see FIG. 6). Also, at a position close to the end face (43) the body is provided with another, similar, access opening (38). Each access opening is of a tapered type of shape increasing in width in a direction towards the upper surface (22) of the body. In this embodiment the lower part of the access opening (38) serves as a recess region (29) in which a retainer (30) may be located. Optionally a retainer may be provided additionally or alternatively in the opening (28).

A thin web section (32) of the body forms a base section of the recess region (29). Beyond that end region, in a direction away from the end (24) towards the end (43), the passage is substantially open to the underneath surface of the body.

Figure 11:
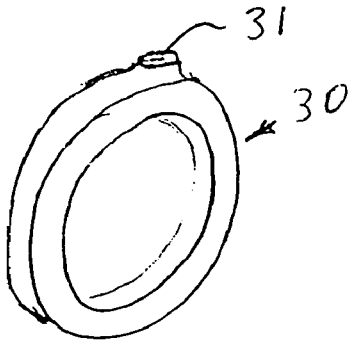
FIG. 11 is a perspective view of a retainer.

The retainer (30) (see FIG. 11) is in the form of an annular metal ring and a grub screw (31) is fitted in a screw-threaded opening in the wall of the ring. In use of the retainer it is inserted in the recess region (29) with the grub screw (31) facing towards the upper surface (22) of the body.

A side wall surface (34) of the access opening (38) serves as a retainer abutment such that when a spacer member is inserted in the passage to abut against the secondary abutment (27), subsequent to tightening of the grub screw to secure the retainer to the end of the spacer member, the abutment of the retainer against said retainer abutment (34) ensures that the counter-balance weight body (20) is secured axially relative to the spacer member.

In addition to the aforedescribed cavities (26), passage (36) and access openings (28,38) the body described in respect of this embodiment of the invention optionally is provided with auxiliary cavities (39) which extend between the upper and lower surfaces (21,22).

Figure 12:
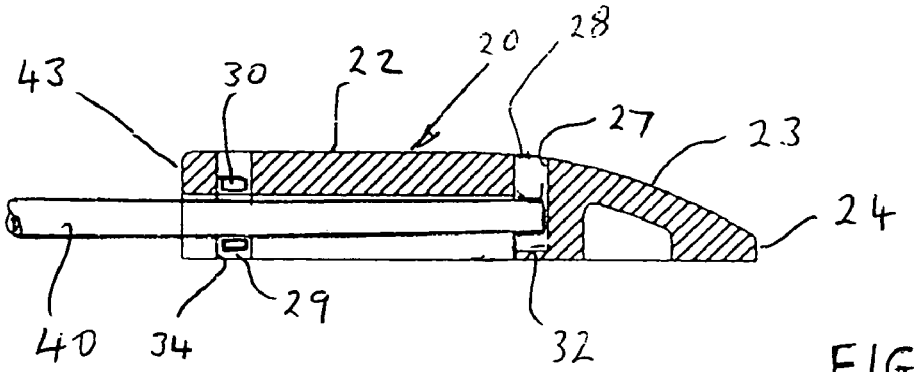
FIG. 12 is a view similar to that of FIG. 10 and showing the body assembled with a spacer member and retainer.

FIG. 12 shows in section part of a spacer tube (40) secured to the counter-balance weight body (20) by means of the aforedescribed retainer (30) positioned in the recess region (29) adjacent the access opening (38).

Figure 13:
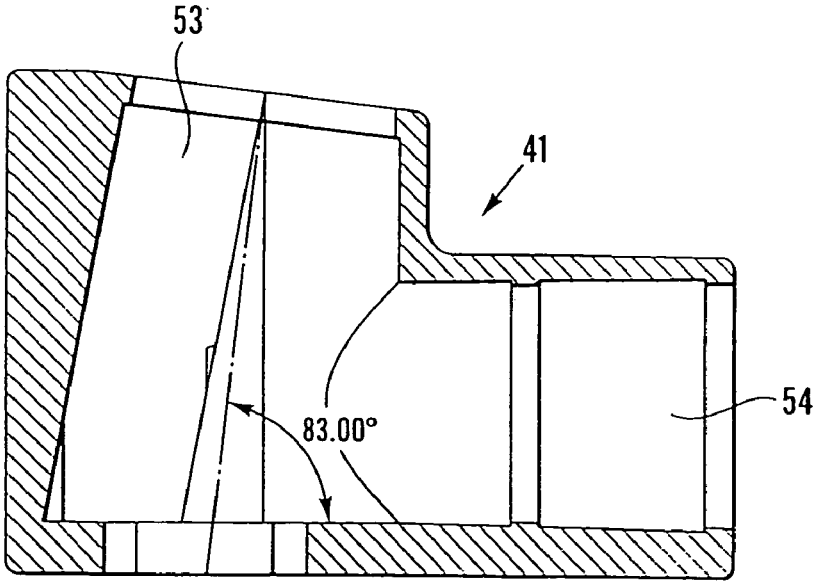
FIG. 13 is a sectional view of a base connector.

One suitable type of base unit for use in combination with the aforedescribed counter-balance weight is shown in cross-section in FIG. 13. The base unit (41) comprises a cast iron body having a first socket (53) to receive the lower end of a vertical post and a horizontal socket (54) to receive the end of a spacer bar. Each socket tapers slightly such that a post or spacer bar can be secured relative to the body of the base unit in any position within a prescribed angle range, in this case an angle range of plus or minus 5 degrees.

Figure 14:
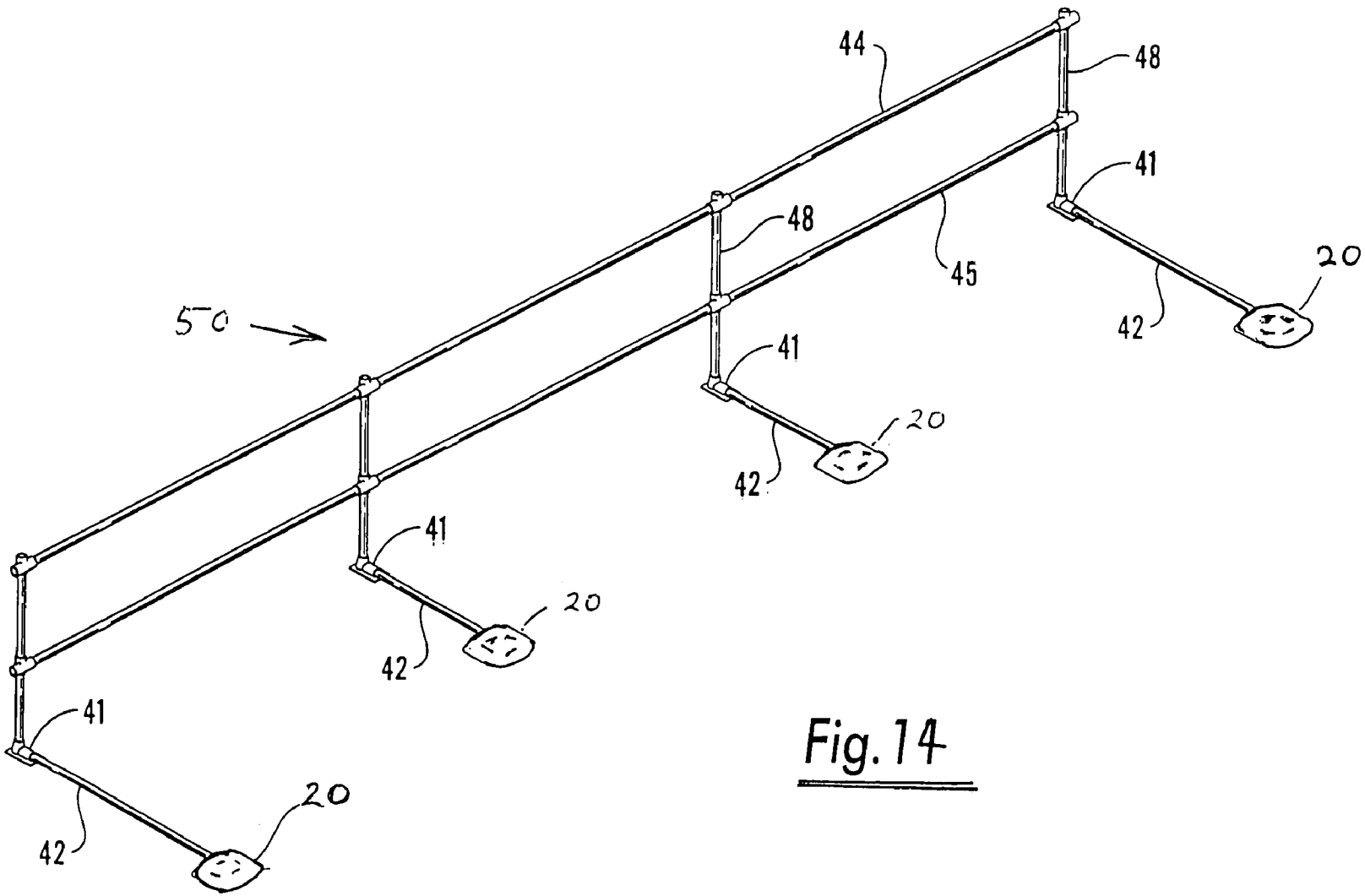
FIG. 14 shows part of a modular safety rail assembly incorporating a counter-balance weight as described with reference to FIGS. 2 to 10.

FIG. 14 shows a short length of a safety rail installation (50) of a modular, free-standing type comprising base units (41), vertical posts (48), horizontal top and intermediate safety rails (44, 45), horizontal spacer bars (42) and counter-balance weights (20) secured to the distal end of each horizontal spacer bar (42). The counter-balance weights (20) are each of the type described above with reference to FIGS. 2 to 10.

The invention claimed is:

1. A counter-balance weight for a modular safety rail comprising a substantially solid body, said body defining a passage to receive an end of an elongate spacer member;

a recess region to house a retainer of a kind selectively securable to the elongate spacer member;

an access opening for access to the retainer, and a retainer abutment to inhibit movement of the retainer in an axial direction which is parallel with the length direction of the elongate member, and a retainer comprising a retainer ring, wherein the size of the access opening enables the retainer to be inserted through that opening into the recess region.

2. A counter-balance weight according to claim 1, wherein the body defines a substantially planar major surface which, in use, is a lower surface intended to rest on a support surface.

3. A counter-balance weight according to claim 1, wherein an upper surface of the body is substantially non-planar and is curved as considered in cross-section.

4. A counter-balance weight according to claim 1, wherein the body is of a substantially triangular shape as considered in transverse section in a plane substantially perpendicular to a length direction of said passage.

5. A counter-balance weight according to claim 1, wherein the body has an upper surface and a lower surface and one of said upper and lower surfaces is formed with said access opening.

6. A counter-balance weight according to claim 1, wherein, in addition to said retainer abutment, the body defines a secondary abutment to inhibit relative axial movement between the spacer member and body in a direction opposite that in which the retainer abutment inhibits movement.

7. A counter-balance weight according to claim 6, wherein the passage is closed at one end and said closed end provides said secondary abutment for contact by the end of a spacer member.

8. A counter-balance weight according to claim 6, wherein the secondary abutment is positioned for contact by the same retainer as that which may contact said retainer abutment.

9. A counter-balance weight according to claim 1, wherein the ratio of the width of the body as considered in a direction parallel with a lower base surface of the body, and perpendicular to the length of the passage, in relation to the height of the body, as considered in a direction perpendicular to said base surface, is greater than 3:1.

10. A counter-balance weight according to claim 9, wherein said ratio is at least 4:1.

11. A counter-balance weight according to claim 9, wherein said passage has a circular section and said height dimension is less than three times the maximum diameter of said passage.

12. A counter-balance weight according to claim 1, wherein said passage is open to a base surface of the body over at least a part of the length of the passage and an end region the passage is not open to the base surface.

13. A counter-balance weight according to claim 1, wherein as considered in a transverse cross-sectional plane perpendicular to the length of the passage the access opening is of a tapered shape increasing in width towards an upper surface of the body.

14. A counter-balance weight according to claim 1, wherein said access opening is provided spaced from a closed end region of the passage.

15. A counter-balance weight according to claim 1, wherein said access opening is provided at a position aligned with an end region of the passage and is dimensioned to allow a retainer to be inserted via the access opening into the end region of the passage, with a part of a wall surface of the access opening serving as a retainer abutment.

16. A counter-balance weight according to claim 1, wherein the retainer is a metal ring the wall of which is provided with a screw threaded opening for supporting a screw member which may be tightened to bear on the surface of an elongate spacer member extending through the ring.

17. A counter-balance weight according to claim 1, wherein the body has an upper surface and a lower surface and one of said upper and lower surfaces is formed with a retainer opening to allow a retainer to be inserted into said recess region.

18. A counter-balance weight according to claim 17, wherein said retainer opening is in the lower surface and said access opening is provided in the upper surface for selectively securing a retainer to a spacer member or for effecting release for disassembly of an installation.

19. A counter-balance weight for a modular safety rail comprising a substantially solid body, said body defining a passage to receive an end of an elongate spacer member;

a recess region to house a retainer of a kind selectively securable to the elongate spacer member;

an access opening for access to the retainer, and a retainer abutment to inhibit movement of the retainer in an axial direction which is parallel with the length direction of the elongate member, and a retainer comprising a retainer ring, wherein the size of the access opening only allows access to the retainer for the purpose of securing the retainer to an elongate spacer member or for release of the retainer.

20. A counter-balance weight according to claim 19, wherein the retainer is a metal ring the wall of which is provided with a screw threaded opening for supporting a screw member which may be tightened to bear on the surface of an elongate spacer member extending through the ring.

21. A counter-balance weight according to claim 19, wherein the body defines a substantially planar major surface which, in use, is a lower surface intended to rest on a support surface.

22. A counter-balance weight according to claim 19, wherein an upper surface of the body is substantially non-planar and is curved as considered in cross-section.

23. A counter-balance weight according to claim 19, wherein the body is of a substantially triangular shape as considered in transverse section in a plane substantially perpendicular to a length direction of said passage.

24. A counter-balance weight according to claim 19, wherein, in addition to said retainer abutment, the body defines a secondary abutment to inhibit relative axial movement between the spacer member and body in a direction opposite that in which the retainer abutment inhibits movement.

25. A counter-balance weight according to claim 24, wherein the passage is closed at one end and said closed end provides a secondary abutment for contact by the end of a spacer member.

26. A counter-balance weight according to claim 24, wherein the secondary abutment is positioned for contact by the same retainer as that which may contact said retainer abutment.

27. A counter-balance weight according to claim 19, wherein the ratio of the width of the body as considered in a direction parallel with a lower base surface of the body, and perpendicular to the length of the passage, in relation to the height of the body, as considered in a direction perpendicular to said base surface, is greater than 3:1.

28. A counter-balance weight according to claim 27, wherein said ratio is at least 4:1.

29. A counter-balance weight according to claim 27, wherein said passage has a circular section and said height dimension is less than three times the maximum diameter of said passage.

30. A counter-balance weight according to claim 19, wherein said passage is open to a base surface of the body over at least a part of the length of the passage and an end region the passage is not open to the base surface.

31. A counter-balance weight according to claim 19, wherein as considered in a transverse cross-sectional plane perpendicular to the length of the passage the access opening is of a tapered shape increasing in width towards an upper surface of the body.

32. A counter-balance weight according to claim 19, wherein said access opening is provided spaced from a closed end region of the passage.

33. A counter-balance weight according to claim 19, wherein said access opening is provided at a position aligned with an end region of the passage and is dimensioned to allow a retainer to be inserted via the access opening into the end region of the passage, with a part of a wall surface of the access opening serving as a retainer abutment.

* * * * *